US010433677B1

(12) United States Patent
Huynh

(10) Patent No.: US 10,433,677 B1
(45) Date of Patent: Oct. 8, 2019

(54) ORGANIZER FOR ORGANIZING HYGIENE ARTICLES

(71) Applicant: Nhut Huynh, Savannah, GA (US)

(72) Inventor: Nhut Huynh, Savannah, GA (US)

( * ) Notice: Subject to any disclaimer, the term of this patent is extended or adjusted under 35 U.S.C. 154(b) by 0 days.

(21) Appl. No.: 16/032,684

(22) Filed: Jul. 11, 2018

(51) Int. Cl.

| | |
|---|---|
| ***A47K 1/09*** | (2006.01) |
| ***A45D 44/04*** | (2006.01) |
| ***A47G 29/08*** | (2006.01) |
| ***A47B 81/02*** | (2006.01) |
| ***A47K 3/40*** | (2006.01) |

(52) U.S. Cl.
CPC ..... *A47K 1/09* (2013.01); *A45D 44/04* (2013.01); *A47B 81/02* (2013.01); *A47G 29/08* (2013.01); *A47K 3/40* (2013.01)

(58) Field of Classification Search
CPC ... A47K 1/09; A47K 3/40; A47K 5/18; A45D 44/04; B44D 3/123; A47G 29/08; A46B 17/02; A47B 81/005; A47B 81/02; A47B 49/00; A47B 49/004; A47F 7/0021; A47F 7/0028; A47F 3/10; A47F 5/02; A47F 5/04
USPC .... 211/70, 65, 163, 196, 205; 248/110, 316; D6/534
See application file for complete search history.

(56) References Cited

U.S. PATENT DOCUMENTS

| | | | | |
|---|---|---|---|---|
| 127,045 | A | 5/1872 | Gardner | |
| 333,900 | A * | 1/1886 | Tatum et al. | A47K 1/09 211/65 |
| 2,117,459 | A * | 5/1938 | Stanton | A47K 1/09 131/256 |
| 5,769,245 | A * | 6/1998 | Butler | A47K 1/09 211/65 |
| D418,706 | S * | 1/2000 | Robishaw | D6/534 |
| 6,641,321 | B2 * | 11/2003 | Horng | A46B 11/0006 206/362 |
| 6,739,462 | B1 * | 5/2004 | Kelly | A47F 7/00 211/163 |
| D499,918 | S * | 12/2004 | Snell | D6/534 |
| 6,935,515 | B1 * | 8/2005 | Sookoo | A46B 15/0091 211/65 |
| D639,095 | S * | 6/2011 | Kraemer | D6/534 |
| 9,204,761 | B2 * | 12/2015 | Volk | A47K 1/09 |
| 9,877,614 | B1 | 1/2018 | Albert | |
| 2003/0196970 | A1 * | 10/2003 | Jiang | A47B 49/00 211/40 |

(Continued)

*Primary Examiner* — Jennifer E. Novosad
(74) *Attorney, Agent, or Firm* — Sanchelima & Associates, P.A.; Christian Sanchelima; Jesus Sanchelima

(57) ABSTRACT

The organizer is used for organizing hygiene articles of various shapes and sizes in a bathroom. Organizer includes a base, a spindle and at least one pair of organizing platforms. Spindle stands upright on base. Each pair of organizing platforms includes a bottom organizing platform and a top organizing platform. Bottom organizing platform is disposed below top organizing platform on spindle. A predetermined distance is maintained between top organizing platform and bottom organizing platform. Bottom organizing platform and top organizing platform is provided with receptacles such that vertically in-line receptacles are of same shape and size. Also, different shapes and sizes of receptacles are provided to accommodate different types of hygiene articles. A rotating element can be additionally provided that facilitates rotation of organizer when rotated by holding a handle provided with spindle.

6 Claims, 4 Drawing Sheets

(56) References Cited

U.S. PATENT DOCUMENTS

| | | | | |
|---|---|---|---|---|
| 2005/0040121 | A1* | 2/2005 | Aros | A47F 5/02 211/58 |
| 2006/0180559 | A1* | 8/2006 | Roberti | B44D 3/12 211/65 |
| 2007/0084810 | A1* | 4/2007 | Morris | A47K 1/09 211/65 |
| 2009/0014399 | A1* | 1/2009 | Bott | A47K 1/09 211/85.12 |
| 2010/0000951 | A1* | 1/2010 | Morris | A47K 1/09 211/65 |
| 2013/0037503 | A1* | 2/2013 | Cimino | A47G 25/0664 211/85.3 |

* cited by examiner

ORGANIZER FOR ORGANIZING HYGIENE ARTICLES

BACKGROUND OF THE INVENTION

1. Field of the Invention

The present disclosure relates to an article organizer. More particularly, the present disclosure relates to an organizer for use in a bathroom to organize hygiene articles.

2. Description of the Related Art

In most of the houses, bathroom sink counters are utilized to place a number of differently shaped and sized hygiene articles such as toothbrushes, toothpaste, face washes, hair sprays and the like. Such hygiene articles are scattered all over bathroom sink counters thereby cluttering bathroom sink counters. Hence, there is a need for an organizer for use in a bathroom to organize hygiene articles.

Several designs for toiletry organizer or storage boxes have been designed in the past. None of them, however, includes an organizer for use in a bathroom to organize hygiene articles that is structurally simple, convenient to use and easy to move from one place to other.

Applicant believes that a related reference corresponds to U.S. Pat. No. 9,877,614 filed by ALFRED ALBERT for a sink-based toiletry organizer with integrated drain. The Alfred reference discloses a sink based toiletry organizer with integrated drain. However, the toiletry organizer is required to be positioned nearby sink because of integrated drain. Also, toiletry organizer has more number of structurally complex components.

Another related application is US patent application 20090127045 filed by Nicole Williams for a roll-up hanging toiletry organizer and diaper bag organizer. The Nicole reference discloses a hanging toiletry organizer having three-layers of flat panel with see-through pockets. However, the organizer requires a hook for hanging and cannot be positioned to other places except having other hook.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide an organizer for organizing hygiene articles in a bathroom.

It is an object of the present invention to provide an organizer that organizes various hygiene articles and is multi-positional either on a bathroom sink counter, in a cabinet under bathroom sink counter or any other flat surfaces.

It is yet another object of the present invention to provide an organizer that is rotatable to easily access hygiene articles.

It is still another object of the present invention to provide an organizer having receptacles of different sizes and shapes to accommodate various sizes and shapes of hygiene articles.

It is another object of the present invention to provide an organizer that organizes hygiene articles that is simple in construction with fewer components and is structurally simple.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
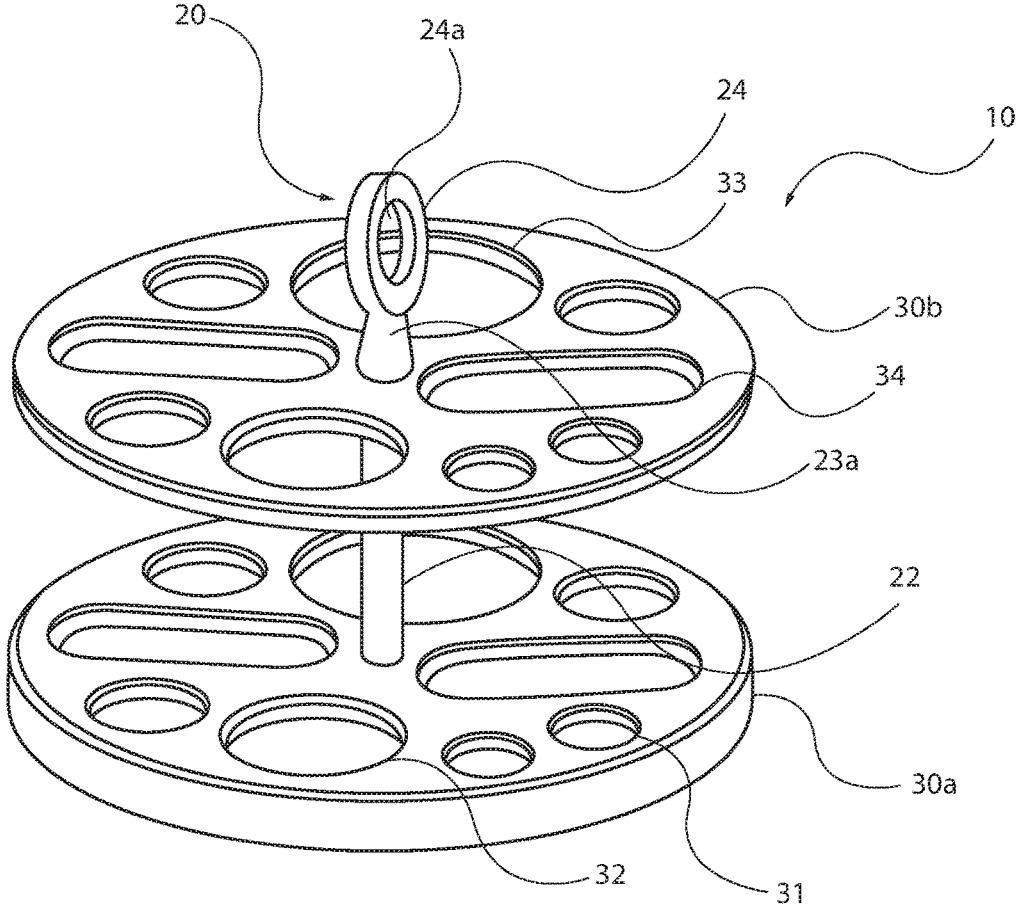
FIG. 1 represents an isometric view of an organizer that organizes hygiene articles having a pair of platforms with corresponding receptacles for receiving hygiene articles.
Figure 2:
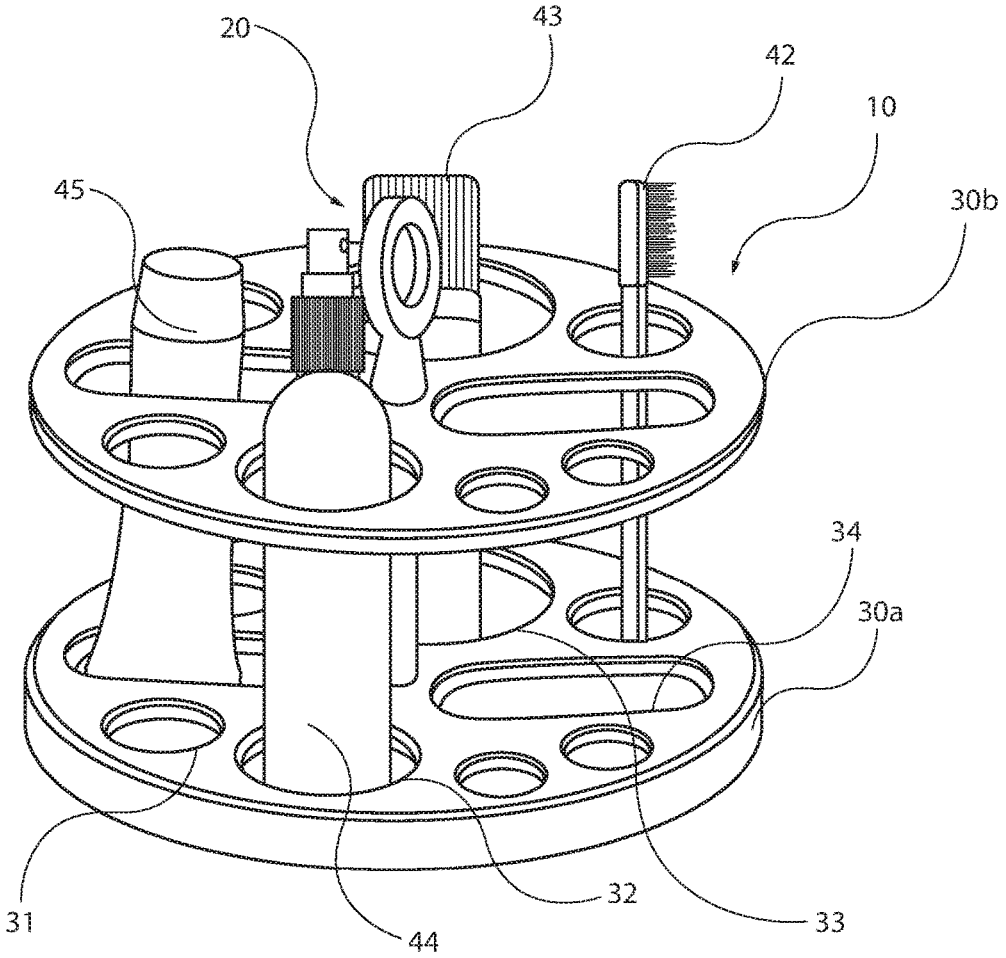
FIG. 2 demonstrates another isometric view of the organizer with various hygiene articles disposed in an organized manner.

Referring now to the drawings, FIGS. 1-5, where the present invention is generally referred to with numeral 10, it can be observed that an organizer for use in a bathroom to organize hygiene articles, in accordance with one embodiment, is provided that mainly includes a base 21, a spindle 20 and at least one pair of organizing platforms 30*a* and 30*b*.

Base 21 supports various components of organizer 10. Spindle 20 stands upright on the base 21. Base 21 can be an integral part of the spindle 20 or can be separate components that can be easily assembled. In an exemplary embodiment, spindle 20 has a male threaded portion (not illustrated in Figures) which connects with a corresponding female threaded portion (not illustrated in Figures) configured in base 21.

At least one pair of organizing platforms 30*a* and 30*b* are connected to spindle 20. More specifically, organizing platform 30*a* passes through spindle 20 till organizing platform 30*a* gets seated on base 21. Organizing platform 30*b* also passes through spindle 20 and is fixed at a per-determined vertical distance above organizing platform 30*a*. This per-determined vertical distance between organizing platform 30*a* and organizing platform 30*b* is selected such that hygiene articles when inserted can rest on organizing platform 30*b* and project out of organizing platform 30*a* for a user to easily access hygiene articles.

In accordance with one embodiment, spindle 20 has base 21 and organizing platform 30*a* inserted within spindle 20 and rests on a resting portion 21*a*. Spindle 20 also is provided with a portion 22 that is at a distance equal to the pre-determined vertical distance. Portion 23 is upstanding above portion 22 and is small in size than portion 23. Due to difference in sizes, a rest 22*a* is formed on which organizing platform 30*b* rests. A tapered portion 23*a* is provided above portion 23. A handle 24 is disposed on tapered portion 23*a*. Handle 24 can optionally have an opening 24*a* for inserting a finger of a user to lift and position organizer 10 from one place to other. Handle 24 can be integral with taper portion 23*a* or can be connected by a threaded arrangement.

In an alternative embodiment, spindle 20 can be of substantially uniform diameter or tapered having operative top as a narrow portion and organizing platform 30*a* and 30*b* is press-fitted with spindle 20.

Organizing platforms 30*a* and 30*b* are defined with a plurality of receptacles for receiving hygiene articles. We herein consider that organizing platform 30*a* is a bottom organizing platform and organizing platform 30*b* is a top organizing platform. Hence, vertically in-line receptacles of the at least one bottom organizing platform and the at least one top organizing platform are identical. Receptacles can be of varied shapes and sizes to accommodate different types of hygiene articles with different shapes and sizes. For example, organizing platforms 30*a* and 30*b* have identical receptacles 31 to 34. Receptacles 31 to 33 are circular and receptacle 31 is of smallest size, receptacle 33 is largest size and receptacle 32 is of intermediate size. Receptacle 34 is oval shape. Thus, receptacles can be of different shapes and sizes.

Of the pair of organizing platforms 30*a* and 30*b*, a bottom organizing platform i.e. organizing platform 30*a* having blind receptacles to support hygiene articles and a top organizing platform i.e. organizing platform 30*b* has through receptacles.

Figure 3:
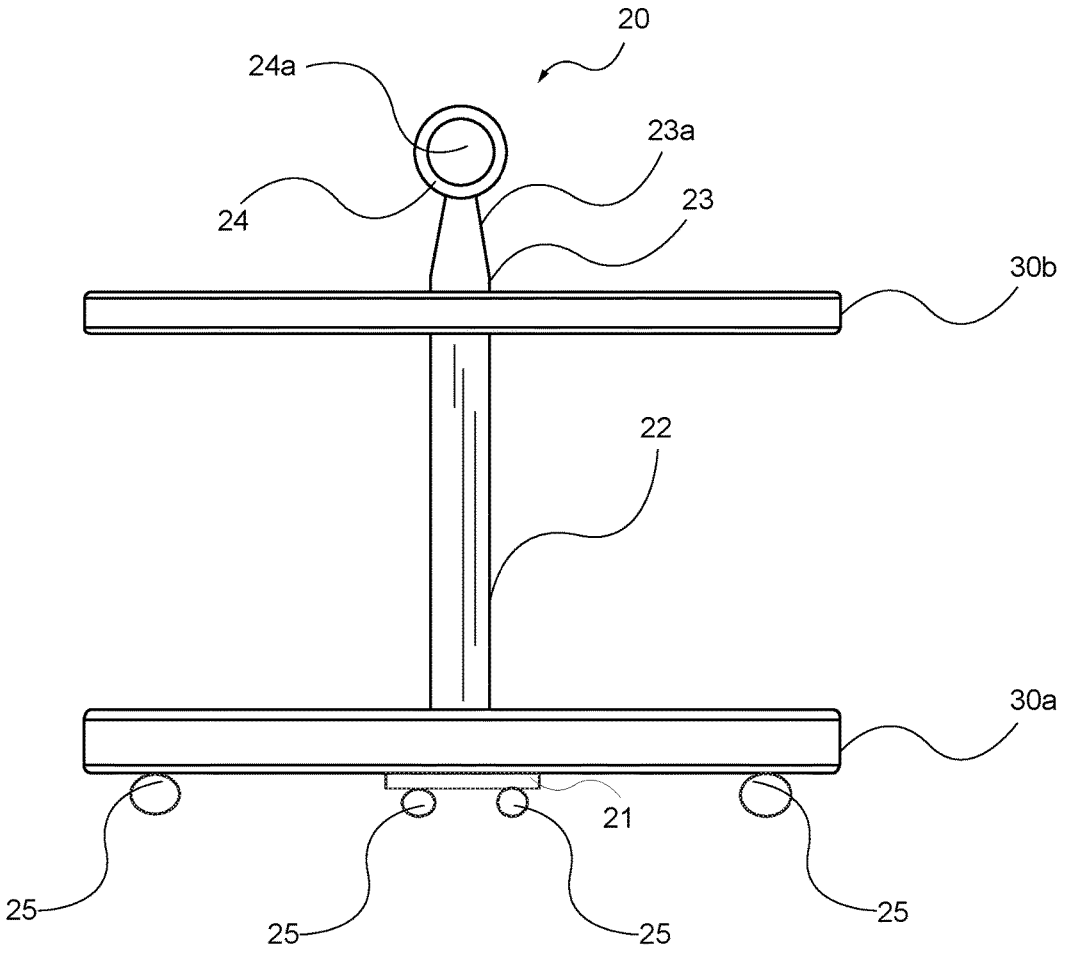
FIG. 3 shows a front view of the organizer of FIG. 1 with wheels provided at the bottommost platform.
Figure 4:
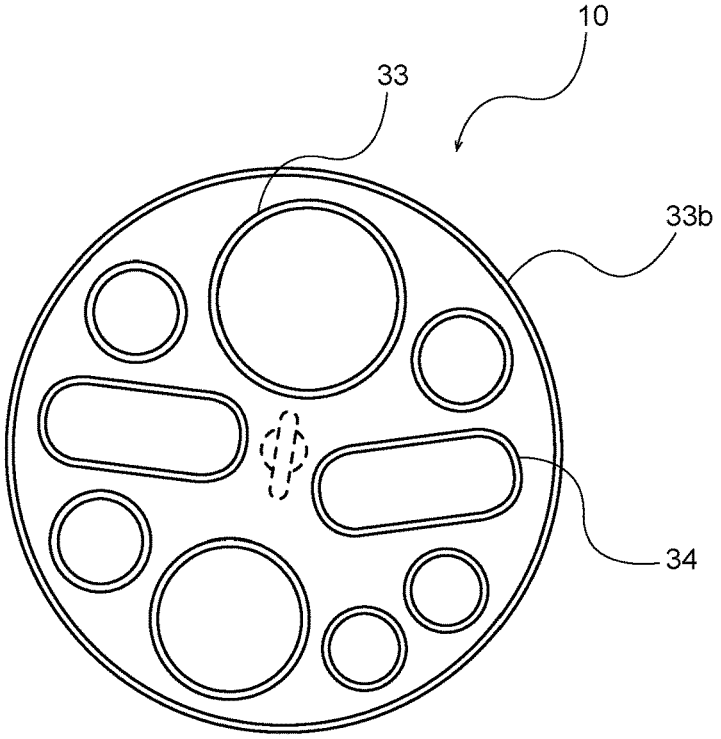
FIG. 4 is a top view of the organizer of FIG. 1 having differently shaped and sized receptacles.
Figure 5:
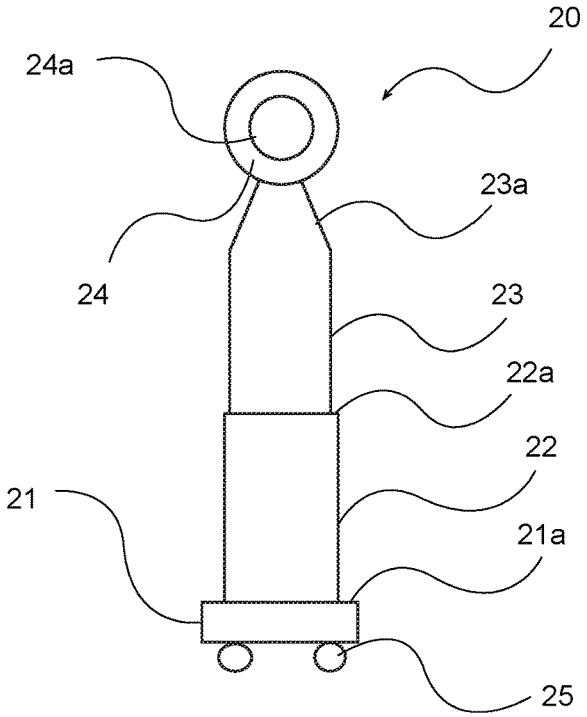
FIG. 5 is a front view of a spindle of the organizer of FIG. 1.

In one embodiment as illustrated in FIG. 3, the bottommost organizing platform, i.e. organizing platform 30*a* of the present disclosure, is provided with a plurality of rotating elements 25 underneath the bottommost organizing platform. In other embodiment as illustrated in FIG. 5, a plurality of rotating elements 25 is disposed underneath base 21. Rotating elements 25 rotates the organizer 10 in event when spindle 20 is rotated. Rotating elements can be wheels or balls.

Hygiene articles of the present disclosure can be one or more of a toothbrush, a tooth-paste, a deodorant bottle, a hair spray, a razor blade, a shaving cream, a body lotion and the like. As illustrated exemplarily in FIG. 2, organizer 10 organizes a toothbrush 42, a deodorant bottle 43, a spray bottle 44 and a toothpaste tube 45.

In one embodiment, organizer 10 for organizing hygiene articles can be of multiple layers, such that one pair of organizing platforms is disposed over other pair of organizing platforms.

Organizer 10 can be positioned at various locations such as a bathroom sink counter, a cabinet provided under the bathroom sink or on any such flat surfaces by easily lifting and placing using handle 24.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An organizer for organizing hygiene articles, said organizer comprising:

a. a base;

b. a spindle standing upright on said base;

c. at least one pair of organizing platforms connected to said spindle having a predetermined vertical distance therebetween;

d. said at least one pair of organizing platforms defined by a top organizing platform and a bottom organizing platform;

e. said top organizing platform includes a plurality of through receptacles that are aligned with corresponding blind receptacles located on said bottom platform, thereby allowing hygiene articles to be held in place using said through receptacles and their corresponding blind receptacles;

f. said spindle includes a handle extending therefrom, said handle has a ring shaped configuration that has a circumference and an open interior space within said circumference, thereby permitting the organizer to be hung;

g. a supporting surface upon which said organizer is positioned on; and h. a wheel assembly including a plurality of wheel members located underneath said base and coining in direct contact with said supporting surface, thereby permitting directional and rotational movement of the device entirely.

2. The organizer of claim 1, wherein said through receptacles and the corresponding blind receptacles are identical in shape.

3. The organizer of claim 1, wherein said through receptacles and the corresponding blind receptacles are identical in size.

4. The organizer of claim 1 wherein said supporting surface is a table or countertop.

5. The organizer of claim 1 wherein said top organizing platform and said bottom organizing platform are of identical diameter.

6. The organizer of claim 1 wherein said bottom organizing platform is mounted on top of said base.

* * * * *